United States Patent [19]

Schwartz et al.

[11] Patent Number: 4,871,555

[45] Date of Patent: Oct. 3, 1989

[54] INFUSION, STIRRING AND HANGING DEVICE FOR PREPARING BEVERAGE

[76] Inventors: Erez Schwartz; Zvi Schwartz, both of 15 Kinereth Street, Bnei-Brak, Israel, 51201

[21] Appl. No.: 175,173

[22] Filed: Mar. 30, 1988

[30] Foreign Application Priority Data

Sep. 27, 1981 [IL] Israel ..... 63942

[51] Int. Cl.[4] ..... B65D 33/02; B65D 30/02; B65D 33/06; B65B 29/04

[52] U.S. Cl. ..... 426/82; 206/0.5; 206/820; 16/110 R; 16/DIG. 12; 426/110; 426/394; 383/12; 53/413

[58] Field of Search ..... 426/77–84, 426/110, 112, 394; 206/0.5, 820; 16/110 R, DIG. 12; 383/23, 28, 12, 19, 17, 18, 22, 25, 26; 425/DIG. 109

[56] References Cited

U.S. PATENT DOCUMENTS

| | | | |
|---|---|---|---|
| 489,468 | 1/1893 | Dillingham | 426/82 |
| 634,349 | 10/1899 | Humphrey | 426/82 |
| 723,287 | 3/1903 | Lawson et al. | 426/77 |
| 1,758,347 | 5/1930 | Beibin | 383/12 |
| 2,149,713 | 3/1939 | Weber | 426/394 |
| 2,192,605 | 3/1940 | Salfisberg | 426/82 |
| 2,377,118 | 5/1945 | Weisman | 426/110 |
| 2,406,018 | 8/1946 | Irmscher | 426/83 |
| 2,472,094 | 6/1949 | Cowles | 383/23 |
| 2,805,162 | 9/1957 | Kovell | 426/82 |
| 2,879,613 | 3/1959 | De Mario | 426/82 |
| 3,016,136 | 1/1962 | Poupitch | 206/820 |
| 3,057,728 | 10/1962 | Parrilla | 426/77 |
| 3,131,065 | 4/1964 | Salomon | 426/82 |
| 3,241,658 | 3/1966 | Anderson | 206/820 |
| 3,257,212 | 6/1966 | Kasket | 426/82 |
| 3,548,906 | 12/1970 | Murphy | 383/25 |
| 3,657,994 | 4/1972 | Post | 426/82 |
| 3,692,536 | 9/1972 | Fant | 426/79 |
| 4,025,655 | 5/1977 | Whyte | 426/82 |
| 4,141,997 | 2/1979 | Syroka | 426/82 |
| 4,215,628 | 8/1980 | Dodd | 426/82 |
| 4,410,550 | 10/1983 | Gaskill | 426/82 |
| 4,465,697 | 8/1984 | Brice et al. | 426/82 |

FOREIGN PATENT DOCUMENTS

| | | | |
|---|---|---|---|
| 158511 | 10/1985 | European Pat. Off. | 426/77 |
| 1795868 | 9/1959 | Fed. Rep. of Germany | 426/82 |
| 3034017 | 4/1982 | Fed. Rep. of Germany | 426/134 |
| 3704781 | 9/1987 | Fed. Rep. of Germany | 426/80 |
| 1090779 | 10/1953 | France | 426/83 |
| 2546134 | 10/1982 | France | 426/77 |
| 10980 | of 1898 | United Kingdom | 206/0.5 |
| 114093 | 3/1918 | United Kingdom | 206/0.5 |
| 1601335 | 10/1981 | United Kingdom | 426/77 |

OTHER PUBLICATIONS

Tea & Coffee Trade J., 1/53, pp. 39, 41.

*Primary Examiner*—Steven Weinstein
*Attorney, Agent, or Firm*—Brumbaugh, Graves, Donohue & Raymond

[57] ABSTRACT

The invention relates to an infusion, stirring and hanging device for preparing beverage in a container comprising a porous bag made of a liquid permeable material containing an infusible substance, and a rigid, non-toxic unit having one section located within said porous bag and another section protruding therefrom, the protruding section having rigid or partially flexible hanging means, enabling the hanging of said device on the rim of said container.

6 Claims, 3 Drawing Sheets

INFUSION, STIRRING AND HANGING DEVICE FOR PREPARING BEVERAGE

FIELD OF THE INVENTION

The present invention relates to novel means for preparing beverages, in particular to infusion bags having rigid elements therein, and provided with rigid or partially flexible hanging means.

BACKGROUND OF THE INVENTION

It is known to prepare beverages, in particular tea, by using a liquid permeable container containing tea leaves or a beverage extract. The beverage is prepared by utilizing the known devices in the following manner: The water permeable container, containing the beverage extract, is placed in a cup with the required amount of water added thereto, for a desired period of time. The water extracts the beverage extract, or the tea leaves, while the tea leaves remain in the container. When sufficient extraction had been achieved, the device is withdrawn from the cup and the beverage, clear of any traces of extracts or tea leaves, is ready for drinking.

Of the known devices for preparing beverages in the above manner, there are known the rigid devices made of metal or rigid heat-proof plastic comprising a rigid container attached to a rigid handle. The container is filled with the required amount of tea leaves prior to use and its content is disposed of thereafter. Such devices require cleaning and washing of the container after use, and therefore, their appeal to the user is limited.

Contrary to the abovementioned rigid, non-disposable devices, there are also known disposable devices mad e of porous liquid permeable bags, in particular paper bags, containing the beverage extract, or the tea leaves, and having handling means. Such handling means are designed to allow the insertion of the bag into the water in the cup, and then, after sufficient steeping has been achieved, withdrawal thereof, without the need to touch the wet bag or to utilize any additional device such as a tea spoon. Such handling means are usually made , of flimsy, flexible material, such as a cotton or a plastic string, aluminum foil or thin plastic band, and while the tea bag floats in the liquid they are supposed to hang over the rim of the cup. However, it is found in practice, that these known handling means do not meet the requirements set up by their design, and most often slide into the liquid, and thereafter are only removable with some difficulty and with accompanying mess. Furthermore, the sliding of the handling means, which were in contact with the hands of the user, can contaminate the beverage and incure non hygienic aspect to the use of such known means.

In order to overcome some of the problems created by the handling means as outlined above, it was suggested to use liquid permeable bags provided with rigid handles. Israel Pat. No. 34607 discloses a beverage bag provided with a rigid bar secured to the bag and to which is integrally formed a rigid handle which projects out of the bag. Such device overcomes the inadequacy of mess created by the sliding into the cup of the known flexible handling means. However, it creates other problems stemming from the fact that when the beverage bag is placed in the cup, the bag rests on the bottom of the cup and does not float in the liquid, thereby decreasing the infusion and increasing the chance of damage to the delicate bag due to frictional forces between the cup and the bag, a damage which can result in the spill of the tea leaves into the cup.

Therefore, it is the object of the present invention to provide a device which overcomes the above mentioned inadequacies of the prior art devices and provides an improvement which is a significant contribution to the advancement of the infusion art.

SUMMARY OF THE INVENTION

In accordance with the invention there is provided an infusion, stirring and hanging device for preparing beverage in a container comprising a porous bag made of a liquid permeable material containing an infusible substance, and a rigid, non-toxic unit having one section located within said porous bag and another section protruding therefrom, the protruding section having rigid or partially flexible hanging means, enabling the hanging of said device on the wall of said container.

The hanging of the device on the wall of the container enables the floating of the bag in the liquid, thereby causing effective infusion while minimizing the chances of effecting any damage to the bag.

The infusible substance can be any substance suitable for preparing a beverage such as tea leaves, coffee, juice extract, soup powder and the like.

The container in which the beverage is prepared can be any known container used for drinking beverages, such as a cup or a glass, or any container used for serving beverages such as a pitcher or a tea pot.

The section of the rigid unit located within the porous bag contributes to the rigidity of the bag, thereby decreasing the chances of the bag to tear. The section of the rigid unit located out of the bag serves as a handle and a hanger, allowing the infusion of the beverage while the hanger is resting on the rim of the cup or is clipped to the upper wall thereof, and the bag is floating in the liquid. When required, the rigid unit can be used as a stirrer, thereby increasing the infusion of the beverage. Alternatively, the rigid unit can replace, when required, other stirring devices, such as the replacement of a teaspoon which is commonly used for the dissolution of sugar, or on other sweetener in the cup, or for the mixing with other liquid such as when adding milk after tea of coffee had been prepared in the container.

An additional advantage of the present invention is that the hanging of the bag on the wall of the cup allows, if required, drinking from the cup without removing the bag therefrom.

Preferably the rigid unit comprises a rectangular frame having outer dimensions substantially equal or slightly smaller than the dimensions of the porous bag and a bar extending from the frame. The end section of the bar is shaped to allow for an easy grip of the rigid unit by the fingers of the user for an easy introduction and removal of the infusion device to and from the container and for the hanging of the end section on the rim of the container. The dimensions of the rigid unit are such that when the rectangular frame is within the container and the end section of the bag hangs on the rim of the container, the frame does not touch the bottom of the container. It is preferable that the hanging means are in the form of a groove located at the bottom part of the end section of the bar wherein the width of the groove allows the end section of the bar to rest on various width of wall container, ranging between thin glasses to thick ceramic containers.

The invention also provides for a rigid unit adapted to be used in an infusion stirring and hanging device for preparing beverage in a container comprising a rectangular frame and a bar extending therefrom, the end section of said bar provided with hanging means enabling the hanging of said unit on the rim of the container.

The invention further provides for a sequence of two or more infusion, stirring and hanging devices attached one to the other by an easily detachable means.

The rigid unit of the invention can be made of any lightweight, non-toxic material such as wood, metal, ceramic or plastics. Preferably, the rigid unit of the invention is made of a plastic material.

The porous bag of the invention can be any non-toxic porous material which can hold the .infusible substance and withstand the temperature of the liquid used for preparing the beverage, such as paper, plastic or cloth. Preferably, the porous bag of the invention is made of porous paper.

BRIEF DESCRIPTION OF THE DRAWINGS

The invention will become more clearly understood in connection with the following detailed description of preferred embodiments which are illustrated in the accompanying drawings in which.

DETAILED DESCRIPTION OF THE INVENTION

Figure 1:
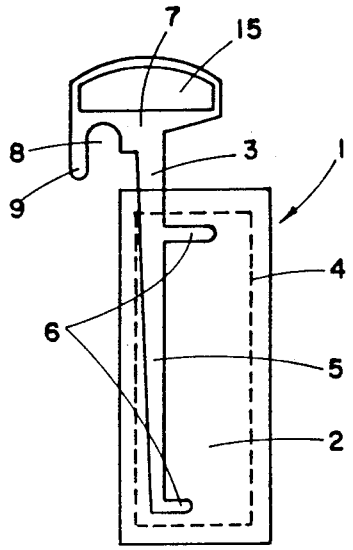
FIG. 1 is a frontal view of an infusion, stirring and hanging device according to the invention.

The infusion, stirring and hanging device 1 shown in FIG. 1 has a rectangular porous paper bag 2 containing tea leaves, coffee or other beverage extract (not shown in figure) and a rigid unit 3, one section of which is located within bag 2, while the other section extend out of the bag. Paper bag 2 is sealed along its four edges by known sealing means and the sealed area is marked schematically in drawing 1 by the dashed lines having the numerical value 4. For the purpose of clarity the section of rigid unit 3 located within bag 2 is shown in full lines. The section of rigid unit 3 located within the bag extends from the top of the bag toward the bottom of the bag and comprises a thin plastic bar 5 having two protrusions 6, one protrusion located slightly below the upper part of sealed area 4 and the other protrusion located slightly above the bottom part of sealed area 4. The section of rigid unit 3 located out of bag 2 comprises a handle 7 having hanging means in the form of a rounded groove 8, and a short arm 9 extending from handle 7, groove and arm 9 forming a hook-like shape, which can easily fit on the rim of a cup or a glass. Aperture 15 in handle 7, allows an easy handling of the device 1 by pressing the thumb against the forefinger while handling device 1.

Figure 2:
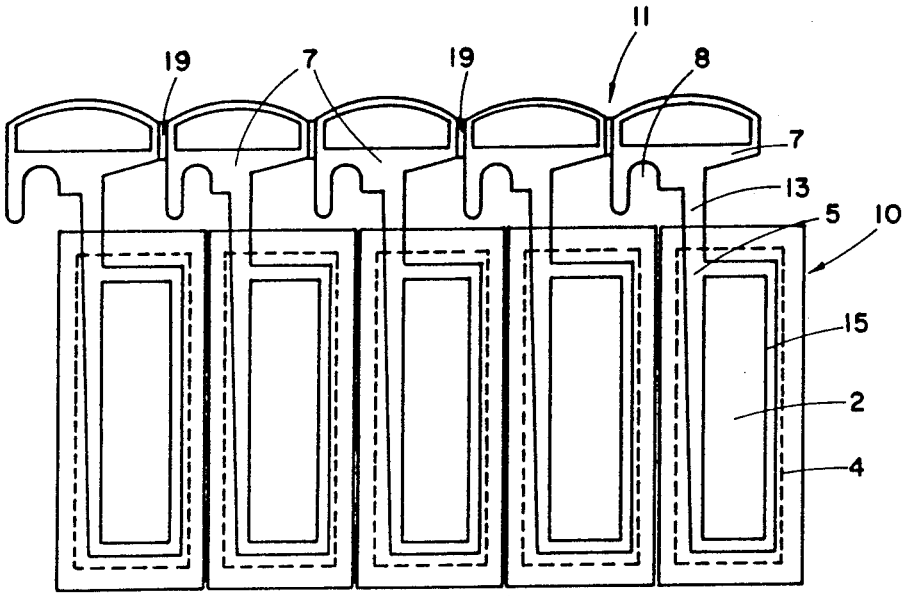
FIG. 2 is a frontal view of sequence of infusion, stirring and hanging devices according to the invention.

FIG. 2 shows a sequence 11 of infusion, stirring and hanging devices 10, similar to device 1 shown in FIG. 1. Device 10 comprises bag 2 and having sealed areas 4, and rigid unit 13 having handle 7 and hanging means 8 and 9. Bar 5 of the section of rigid unit 13 located within bag 2 forms part of a substantially rectangular frame 15 located substantially parallel and adjacent to the sealed area 4 of bag 2. Handles 7 in sequence 11 are connected one to the other by a thin band 19 which is easily breakable by applying slight force on handle 7. Thus each of devices 10 in sequence 11 can be easily detached from each other.

Rigid units 3 and 13 enable to use devices 1 and 10 respectively, as stirrers. Stirring in connection with devices 1 and 10 is called for in order to effect a more efficient extraction of the extract, or tea leaves located within bag 3 and further in order to dissolve and stir other substances, such as sugar, salt, milk extract or liquid milk in the cup.

Figure 3:
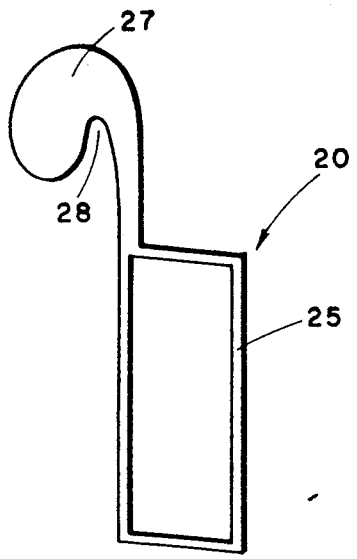
FIG. 3 is a perspective view of a rigid unit according to the invention.

FIG. 3 shows another embodiment of a rigid body 20 comprising a thin frame 25 and a thin flat handle 27, having groove 28 which serves as a hook to hang the rigid unit on the rim of cups or other containers, of various wall thickness. The special design of handle 27 allows an easy grip of the handle between the thumb and the forefinger while handling the unit for stirring or for hanging on the rim of the cup. The flat area of handle 27 can be decorated or carry commercial information in writing.

Figure 4:
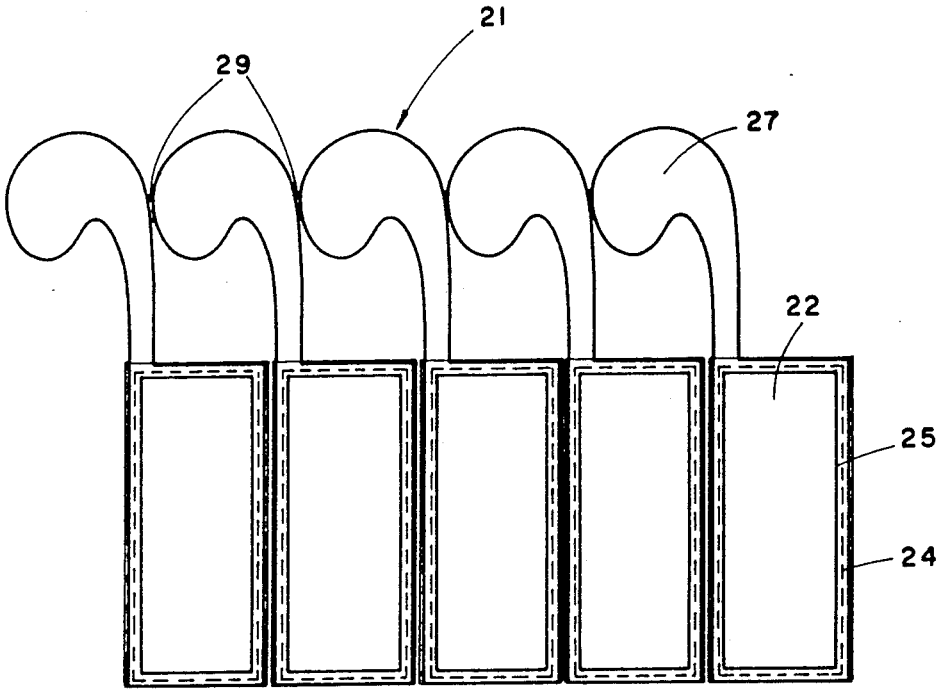
FIG. 4 is a frontal view of sequence of devices comprising the rigid unit shown in FIG. 3.

A sequence 21 of infusion stirring and hanging devices comprising rigid units 20 and porous bags 22 is shown in FIG. 4. Handles 27 are connected one to the other by easy detachable connections 29. The sequence of five frames 20 shown in FIG. 4 is made by injection molding. Any other suitable known method for preparing such sequence of rigid units is also applicable. Connections 29 are of thickness substantially lower than the thickness of handle 27 and therefore connections 29 are easily breakable, when slight force is applied on handle 27. The porous paper used to form porous bags 22 is sealed to both sides of frame 25 by any known sealing means such as by heat sealing, to form the porous bag containing the tea leaves. Thus the size of the bag is substantially the size of the frame. The sealed area is marked schematically in the drawing by numerical value 24.

Figure 5:
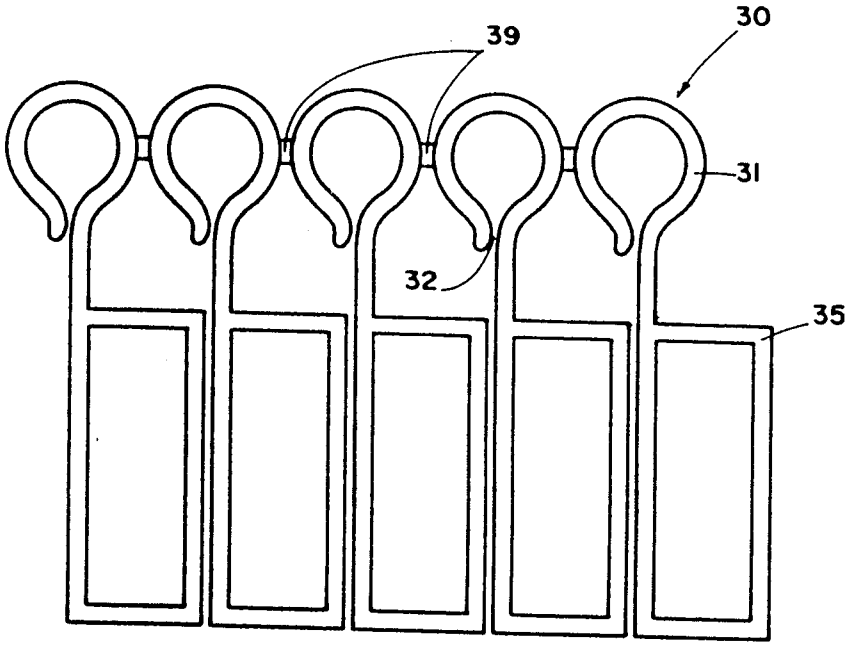
FIG. 5 is a frontal view of another embodiment of the invention.

FIG. 5 shows a sequence of rigid bodies 30, comprising thin frames 35 and round, partially flexible hooks 31 connected one to the other by easily breakable thin bands 39. Gap 32 between the end of hook 31 and its left hand arm, as shown in the drawing, can be expanded due to the partial flexibility of hook 31, and thus allows for the clipping of hook 31 to the upper side of the wall of the container, when required.

We claim:

1. A disposable infusion stirring and hanging device for preparing a beverage comprising:

a porous flexible bag made of a liquid permeable material, an infusable substance contained in said bag and a thin, flat premolded rigid nontoxic element;

said bag comprising side edges and a top and bottom edge;

said element comprising a lower section located within and enveloped by the porous bag and an integral upper section protruding vertically out of the bag;

said lower section comprising a thin bar extending longitudinally within the bag along one of said side edges approximately from the top of the bag to approximately the bottom of the bag with two thin protrusions extending transverse to said bar and either at least partially across the bag or around the perimeter of said bag to form either a partial frame or full frame, respectively, within the bag sufficient to impart rigidity to said bag;

said upper section including a first portion that is a continuation of said thin bar and extending longitudinally from said thin bar and protruding out of the bag along approximately said one side edge, said upper section further including an enlarged portion extending transverse from said longitudinally oriented first portion, and beyond the plane extending normal from said one side edge, said enlarged portion including a longitudinally oriented groove in said enlarged portion that is positioned beyond the plane extending normal from said one side edge, said groove being of a size sufficient to fit on the rim of a cup or glass, said enlarged portion further including an aperture of a size sufficient to allow one to press the thumb against the forefinger through the aperture and employ said rigid element as a stirrer, said length of the element from said enlarged portion to the bottom of said lower section being of a size such that when said groove is fitted onto a rim of said cup or glass said bag hangs on the wall and floats in the liquid in said cup or glass.

2. A disposable infusion, stirring and hanging device for preparing a beverage according to claim 1 wherein the lower section located within the porous bag extends along at least three quarters of the length of said porous bag.

3. A disposable infusion, stirring and hanging device for preparing a beverage according to claim 1 wherein the edges of the liquid permeable material forming the porous bag are sealed to the lower section.

4. A disposable infusion, stirring and hanging device according to claim 1 wherein the premolded rigid non-toxic element is made of a plastic material.

5. A sequence of two or more disposable infusion, stirring and hanging devices according to claim 1 wherein each device is attached one to the other by an easily detachable attachment.

6. A sequence according to claim 5 wherein the disposable infusion, stirring and hanging devices are attached one to the other at the upper ends of the enlarged portion.

* * * * *

UNITED STATES PATENT AND TRADEMARK OFFICE

CERTIFICATE OF CORRECTION

PATENT NO. : 4,871,555

DATED : October 3, 1989

INVENTOR(S) : Erez Schwartz and Zvi Schwartz

It is certified that error appears in the above-identified patent and that said Letters Patent is hereby corrected as shown below:

Item 30, first page, Israeli patent application No. 63942 is not claimed as a priority document.

Signed and Sealed this

Thirteenth Day of November, 1990

*Attest:*

HARRY F. MANBECK, JR.

*Attesting Officer*

*Commissioner of Patents and Trademarks*